US006698840B1

(12) United States Patent
Tseng

(10) Patent No.: US 6,698,840 B1
(45) Date of Patent: Mar. 2, 2004

(54) CHAIR WITH A DETACHABLE BACKREST

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/217,307

(22) Filed: Aug. 12, 2002

(51) Int. Cl.[7] ..... A47C 7/00
(52) U.S. Cl. ..... 297/440.15; 297/440.21
(58) Field of Search ..... 297/440.21, 353, 297/440.1, 440.2, 440.15, 452.18

(56) References Cited

U.S. PATENT DOCUMENTS 3,525,549 A * 8/1970 Knabusch et al.
5,005,908 A * 4/1991 Young
5,184,871 A * 2/1993 LaPointe et al.
5,435,621 A * 7/1995 Komorowski et al.
5,570,930 A * 11/1996 LaPointe et al.
5,658,049 A * 8/1997 Adams et al. ..... 297/440.23
5,954,392 A * 9/1999 Liss et al.

* cited by examiner

*Primary Examiner*—Peter M. Cuomo
*Assistant Examiner*—Stephen Vu
(74) *Attorney, Agent, or Firm*—Ladas & Parry

(57) ABSTRACT

A chair includes a seat and a backrest. A coupling unit includes two engaging tongues respectively extending from opposite sides of the seat, and a pair of brackets respectively fixed on opposite sides of the backrest and defining two tongue-retention channels. Each of the engaging tongues is formed with an engaging hole. Two fastener clips are mounted on the brackets, respectively. Each fastener clip includes a resilient arm having a V-shaped engaging end that is engageable with the engaging hole in a respective one of the engaging tongues.

2 Claims, 6 Drawing Sheets

CHAIR WITH A DETACHABLE BACKREST

BACKGROUND OF THE INVENTION

1. Field of the Invention

The present invention relates to a chair, more particularly to a chair with a detachable backrest.

2. Description of the Related Art

Referring to FIG. 1, a conventional chair is shown to include a seat 11 having opposing front and rear ends, left and right armrest members 12 disposed uprightly on opposite sides of the seat 11, a footrest 15 that extends downwardly and frontwardly from the front end of the seat 11, and a backrest 13 which extends upwardly and rearwardly from the rear end of the seat 11.

The conventional chair is bulky, and is thus inconvenient to transport or store.

SUMMARY OF THE INVENTION

Therefore, the object of this invention is to provide a chair with a detachable backrest so as to facilitate transport and storage thereof.

Accordingly, a chair according to the present invention includes: a seat having a rear portion with two opposite sides; a backrest disposed rearwardly of the seat and having a lower portion with two opposite sides respectively disposed proximate to the opposite sides of the rear portion of the seat; and a coupling unit. The coupling unit includes a pair of spaced apart engaging tongues, a pair of brackets, and a pair of fastener clips. The engaging tongues are respectively fixed on and extend outwardly from the opposite sides of one of the rear portion of the seat and the lower portion of the backrest, respectively. Each of the engaging tongues has a distal end that is formed with an engaging hole confined by a hole-defining wall. The brackets are respectively fixed on the opposite sides of the other one of the rear portion of the seat and the lower portion of the backrest. Each of the brackets defines a tongue-retention channel that extends in a longitudinal direction and that has a mounting end and an inlet end opposite to the mounting end. Each of the engaging tongues is snugly insertable into the tongue-retention channel of a respective one of the backrests via the inlet end. The fastener clips are mounted respectively on the brackets. Each of the fastener clips includes a resilient arm that extends from the mounting end toward the inlet end and that has a V-shaped engaging end distal from the mounting end and projecting in a transverse direction relative to the longitudinal direction into the tongue-retention channel of the respective one of the backrests. The V-shaped engaging end defines an abutment side face and a sliding side face that is opposite to and that extends from the abutment side face, and that is inclined relative to the longitudinal direction. The V-shaped engaging end is resiliently movable relative to the tongue-retention channel such that the V-shaped engaging end resiliently moves in the transverse direction away from the tongue-retention channel of a respective one of the backrests when a respective one of the engaging tongues slides over the sliding side face upon insertion of the respective one of the engaging tongues into the tongue-retention channel of the respective one of the backrests, and such that the V-shaped engaging end resiliently moves toward the tongue-retention channel of the respective one of and into the engaging hole in the respective one of the engaging tongues when the respective one of the engaging tongues passes over the sliding side face to the abutment side face. The abutment side face engages the hole-defining wall of the engaging hole when the respective one of the engaging tongues is pulled away from the tongue-retention channel of the respective one of the backrests so as to prevent undesired removal of the respective one of the engaging tongues from the tongue-retention channel of the respective one of the backrests.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
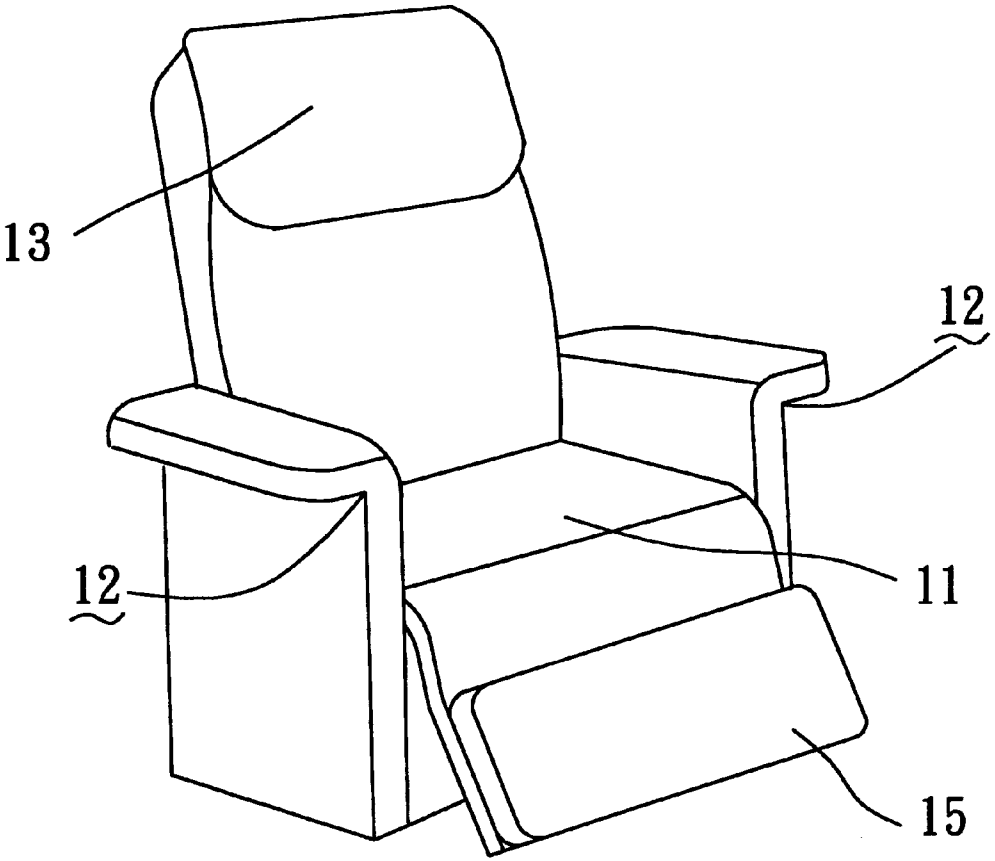
FIG. 1 PRIOR ART
FIG. 1 is a perspective view of a conventional chair.
Figure 2:
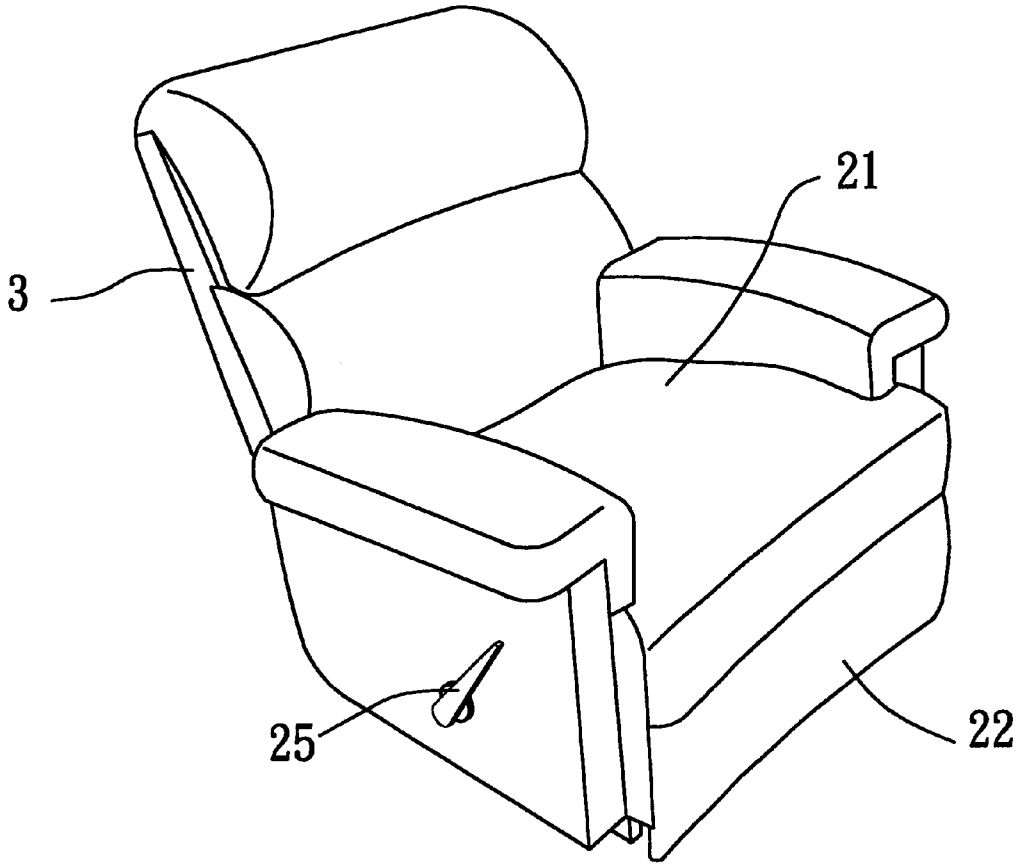
FIG. 2 is a perspective view of the preferred embodiment of a chair according to the present invention.
Figure 3:
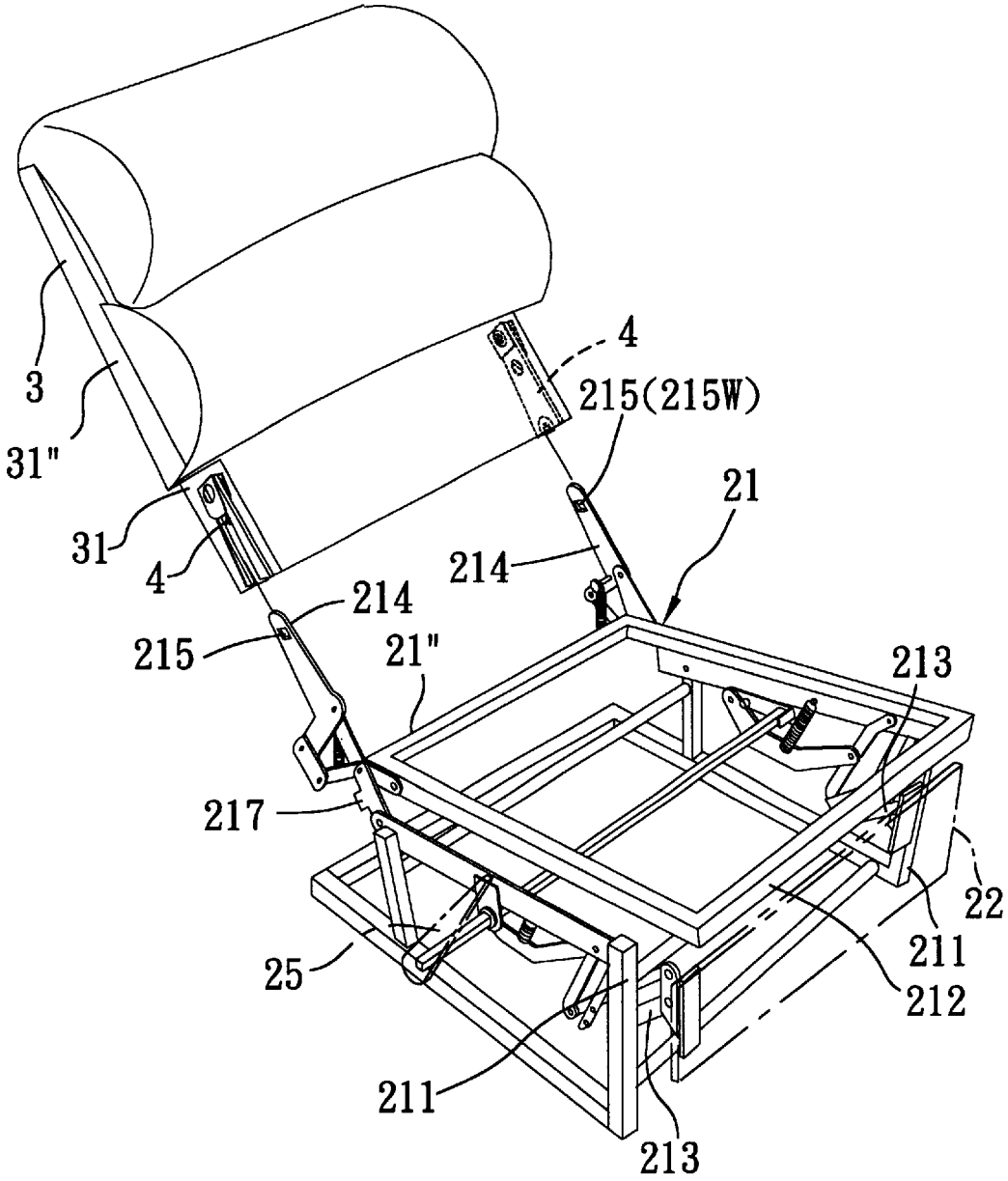
FIG. 3 is a partly exploded view of the preferred embodiment.
Figure 4:
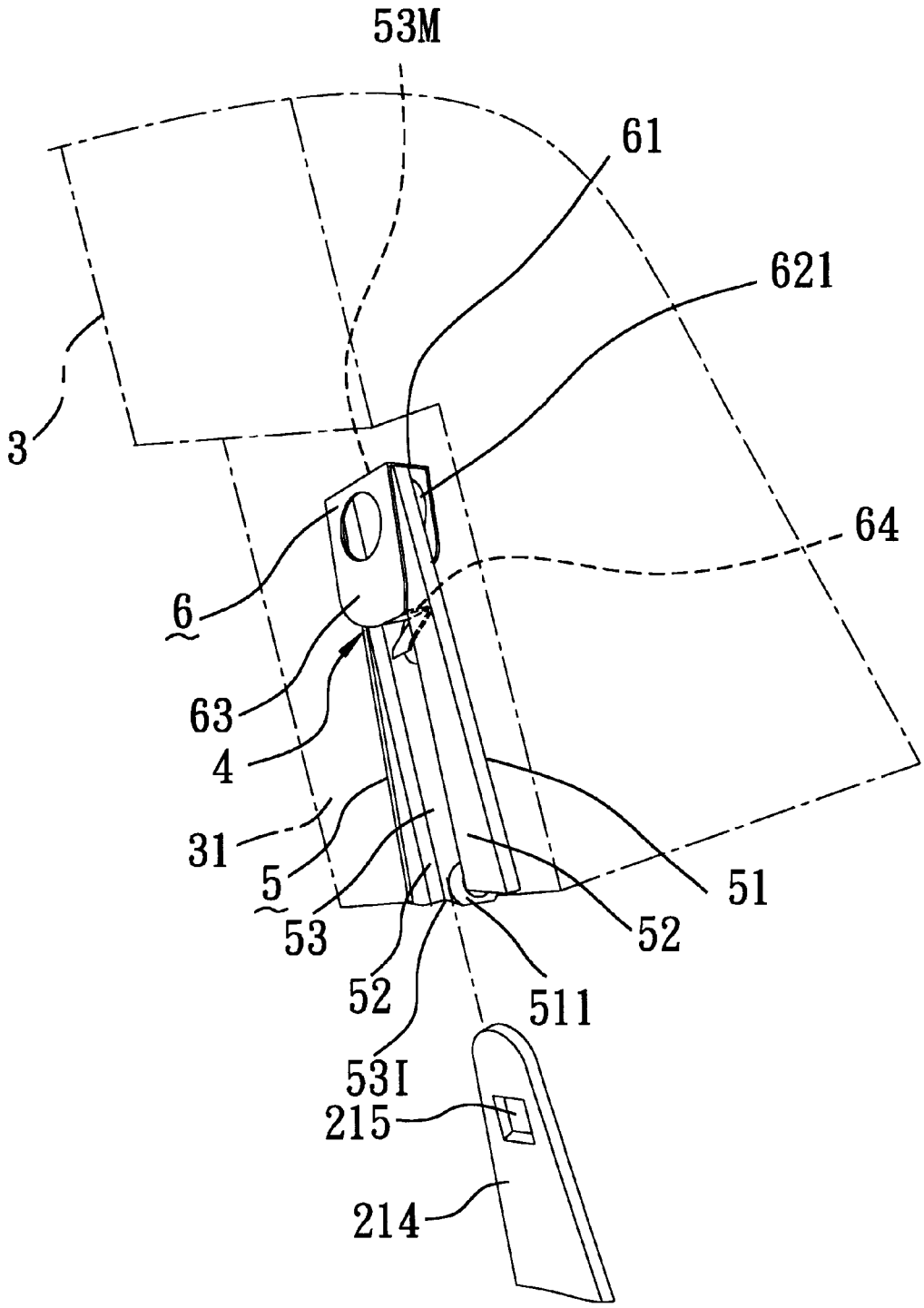
FIG. 4 illustrates how an engaging tongue of a seat is inserted into a tongue-retention channel formed on a backrest of the preferred embodiment.
Figure 5:
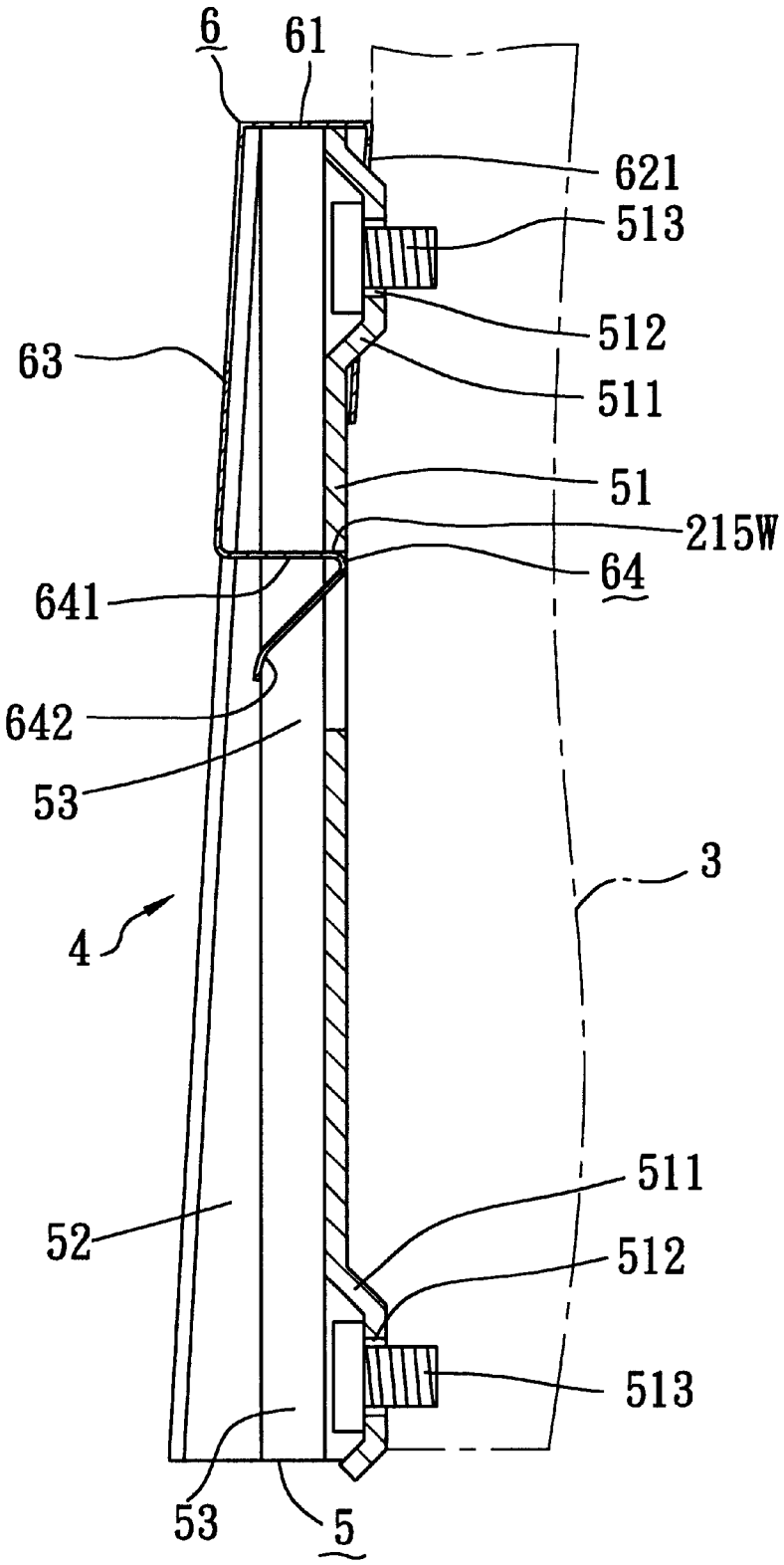
FIG. 5 is a partly sectional view of the backrest of the preferred embodiment, illustrating a position of a fastener clip prior to insertion of the engaging tongue into the tongue-retention channel.
Figure 6:
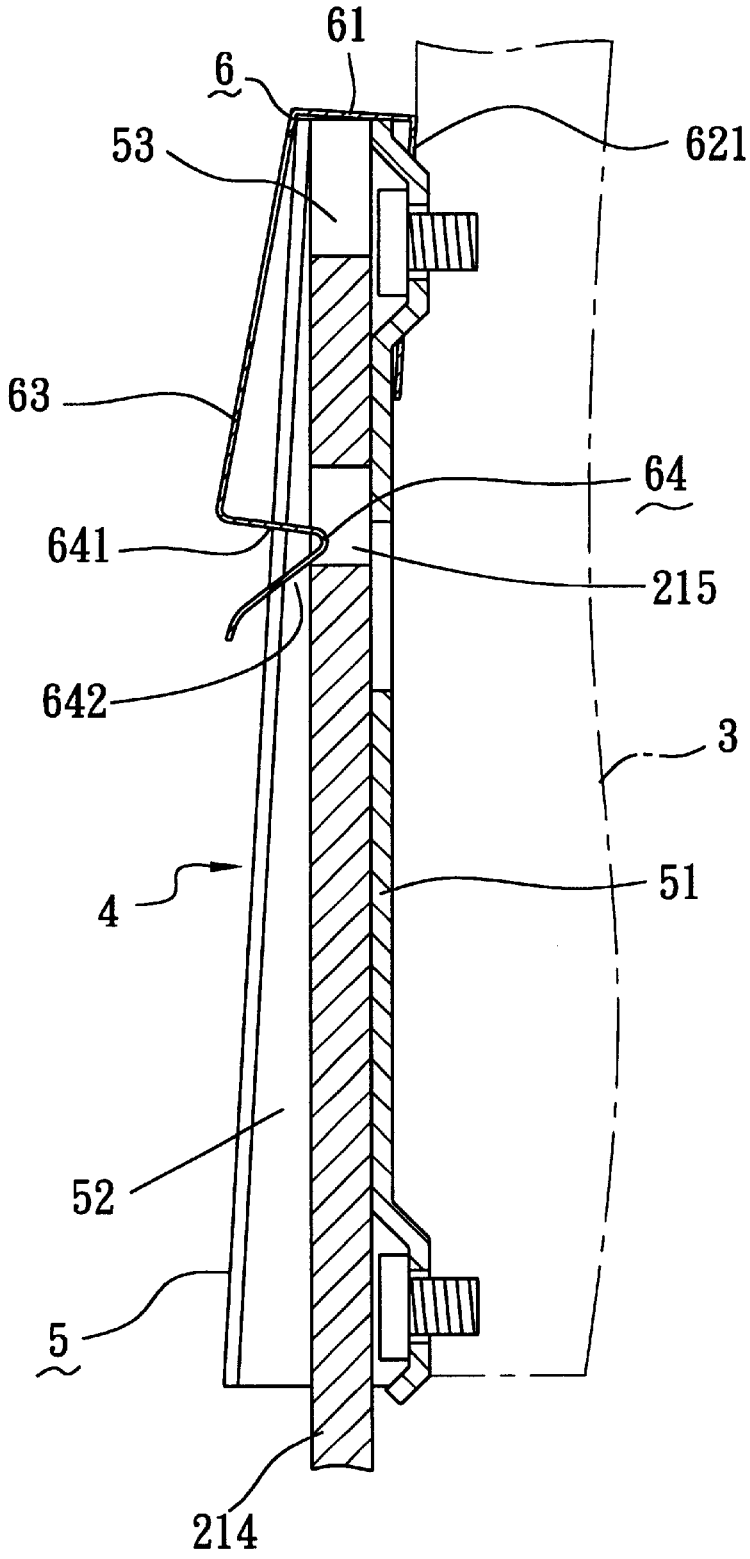
FIG. 6 is a partly sectional view of the backrest of the preferred embodiment, illustrating a position of the fastener clip after insertion of the engaging tongue into the tongue-retention channel.

Referring to FIGS. 2 to 6, the preferred embodiment of a chair according to the present invention is shown to include a seat 21, a backrest 3, and a coupling unit 4.

As illustrated, the seat 21 has a rear portion 21" with two opposite sides, a front portion 212 and a footrest 22 disposed frontwardly of the front portion 212.

The backrest 3 is disposed rearwardly of the seat 21, and has a lower portion 31 with two opposite sides 31" respectively disposed proximate to the opposite sides of the rear portion 21" of the seat 21.

The coupling unit 4 includes a pair of spaced apart engaging tongues 214, a pair of brackets 5, and a pair of fastener clips 6. The engaging tongues 214 are fixed on and extend outwardly from the opposite sides of the rear portion 21" of the seat 21, respectively. Each of the engaging tongues 214 has a distal end that is formed with an engaging hole 215 confined by a hole-defining wall 215W. The brackets 5 are respectively fixed on the opposite sides of the lower portion 31 of the backrest 3. Each of the brackets 5 defines a tongue-retention channel 53 that extends in a longitudinal direction and that has a mounting end 53M and an inlet end 53I opposite to the mounting end 53M. Each of the engaging tongues 214 is snugly insertable into a respective one of the tongue-retention channels 53 of the backrests 5 via the inlet end 53I. The fastener clips 6 are mounted respectively on the brackets 5. Each of the fastener clips 6 includes a resilient arm 63 that extends from the mounting end 53M toward the inlet end 53I and that has an inverted U-shaped mounting portion 61 mounted on the mounting end 53M, and a V-shaped engaging end 64 distal from the mounting end 53M and projecting in a transverse direction relative to the longitudinal direction into the tongue-retention channel 53. The V-shaped engaging end 64 defines an abutment side face 641 and a sliding side face 642 that is opposite to and that extends from the abutment side face 641 and that is inclined relative to the longitudinal direction. The V-shaped engaging end 64 is resiliently movable relative to the respective tongue-retention channel 53 such that the V-shaped engaging end 64 resiliently moves in the transverse direction away from the respective tongue-retention channel 53 when a respective one of the engaging tongues 214 slides over the sliding side face 642 upon insertion of the respective engaging tongues 214 into the respective tongue-retention channel 53, and such that the V-shaped engaging end 64 resiliently moves toward the respective tongue-retention channel 53 and into the engaging hole 215 when the respective one of the engaging tongues 214 passes over the sliding side face 642 to the abutment side face 641 (see FIG. 6). The abutment side face 641 engages the hole-defining wall 215W of the engaging hole 215 when the respective one of the engaging tongues 214 is pulled away from the tongue-retention channel 53 (see FIG. 5). Thus, undesired removal of the engaging tongues 214 from the tongue-retention channels 53 of the backrests 5 is prevented. The backrest 3 can be detached from the seat 21 by simply pulling the V-shaped engaging ends 64 of the resilient arms 63 of the fastener clips 6 from the engaging holes 215 in the engaging tongues 214 so as to permit removal of the engaging tongues 214 from the tongue-retention channels 53 of the backrests 5.

In this embodiment, each of the brackets 5 includes a mounting wall 51 that is fixed on one of the two opposing sides 31" of the backrest 3, that extends in the longitudinal direction, and that has two side edges, and two spaced-apart generally L-shaped flanges 52 which are fixed on and extend from the side edges of the mounting wall 51, respectively, to confine the respective tongue-retention channel 53.

The mounting wall 51 has upper and lower portions 511 which are indented to form upper and lower holes 512. The inverted U-shaped mounting portion 61 of each of the fastener clips 6 is formed with a through hole 621 that is aligned with the upper hole 512 in the mounting wall 51. An upper screw 513 extends through the through hole 621 and the upper hole 512, and is threaded on the respective one of the opposite sides of the lower portion 31 of the backrest 3, thereby securing the upper portion 511 of the mounting wall 51 on the lower portion 31 of the backrest 3. A lower screw 513 extends through the lower screw hole 512 in the mounting wall 51, and is threaded on the respective one of the opposite sides of the lower portion 31 of the backrest 3, thereby securing the lower portion 511 of the mounting wall 51 on the lower portion 31 of the backrest 3.

The seat 21 includes left and right vertical portions 211 disposed at opposite sides of the horizontal front portion 212. A control device is disposed below the horizontal portion 212, extends between the vertical portions 211, and includes an operating lever 25 which is connected to the backrest 3 via a rear linkage unit 217 and which is connected to the footrest 22 via a front linkage unit 213. As such rotation of the operating lever 25 results in synchronous movement of the backrest 3 and the footrest 22 relative to the front portion 212 to adjust inclination of the backrest 3 and the footrest 22 relative to the front portion 212. Since the feature of the present invention does not reside in the control device, a detail description thereof is omitted herein for the sake of brevity.

With this invention thus explained, it is apparent that numerous modifications and variations can be made without departing from the scope and spirit of this invention. It is therefore intended that the invention be limited only as indicated in the appended claims.

I claim:

1. A chair comprising:

a seat having a rear portion with two opposite sides;

a backrest disposed rearwardly of said seat, and having a lower portion with two opposite sides respectively disposed proximate to said opposite sides of said rear portion of said seat; and a coupling unit including a pair of spaced apart engaging tongues respectively fixed on and extending outwardly from said opposite sides of one of said rear portion of said seat and lower portion of said backrest, each of said engaging tongues having a distal end that is formed with an engaging hole confined by a hole-defining wall, a pair of brackets respectively fixed on said opposite sides of the other one said rear portion of said seat and said lower portion of said backrest, each of said brackets defining a tongue-retention channel that extends in a longitudinal direction and that has a mounting end and an inlet end opposite to said mounting end, each of said engaging tongues being snugly insertable into said tongue-retention channel via said inlet end, and a pair of fastener clips mounted respectively on said brackets, each of said fastener clips including a resilient arm that extends from said mounting end toward said inlet end and that has a V-shaped engaging end distal from said mounting end and projecting in a transverse direction relative to said longitudinal direction into said tongue-retention channel of a respective one of said brackets, said V-shaped engaging end defining an abutment side face, and a sliding side face that is opposite to and that extends from said abutment side face and that is inclined relative to said longitudinal direction, said V-shaped engaging end being resiliently movable relative said tongue retention channel of the respective one said brackets such that said V-shaped engaging end resiliently moves in said transverse direction away from said tonque-retention channel of the respective one of said brackets when a respective one of said engaging tongue slides over said sliding face upon insertion of the respective one of said engaging tongue into said tonque-retention channel of the respective one of said brackets and such that said V-shaped end resiliently moves towards said tongue-retention channel of the respective one of said brackets and into said engaging hole in the respective one of said engaging tongues when the respective one of said tongues passes over said sliding side face to said abutment side face, said abutment side face engaging said hole-defining wall of said engaging hole when the respective one said engaging tongues is pulled away from said tongue-retention channel of the respective one of said brackets so as to prevent undesired removal of the respective one said engaging tongues from said tongue-retention channel of the respective one of said brackets, wherein said engaging tongues are fixed on and extended outwardly from said opposite sides of rear portion of said seat, respectively, said pair of brackets being respectively fixed on said opposite sides of said lower portion of said backrest.

2. A chair comprising:

a seat having a rear portion with two opposite sides;

a backrest disposed rearwardly of said seat, and having a lower portion with two opposite sides respectively disposed proximate to said opposite sides of said rear portion of said seat; and a coupling unit including a pair of spaced apart engaging tongues respectively fixed on and extending outwardly from said opposite sides of one of said rear portion of said seat and lower portion of said backrest, each of said engaging tongues having a distal end that is formed with an engaging hole confined by a hole-defining wall, a pair of brackets respectively fixed on said opposite sides of the other one said rear portion of said seat and said lower portion of said backrest, each of said brackets defining a tongue-retention channel that extends in a longitudinal direction and that has a mounting end and an inlet end opposite to said mounting end, each of said engaging tongues being snugly insertable into said tongue-retention channel via said inlet end, and a pair of fastener clips mounted respectively on said brackets, each of said fastener clips including a resilient arm that extends from said mounting end toward said inlet end and that has a V-shaped engaging end distal from said mounting end and projecting in a transverse direction relative to said longitudinal direction into said tongue-retention channel of a respective one of said brackets, said V-shaped engaging end defining an abutment side face, and a sliding side face that is opposite to and that extends from said abutment side face and that is inclined relative to said longitudinal direction, said V-shaped engaging end being resiliently movable relative said tongue retention channel of the respective one of said brackets such that said V-shaped engaging end resiliently moves in said transverse direction away from said tongue-retention channel of the respective one of said brackets when a respective one of said engaging tongue slides over said sliding face upon insertion of the respective one of said engaging tongue into said tongue-retention channel of the respective one of said brackets and such that said V-shaped end resiliently moves towards said tongue-retention channel of the respective one of said brackets and into said engaging hole in the respective one of said engaging tongues when the respective one of said tongues passes over said sliding side face to said abutment side face, said abutment side face engaging said hole-defining wall of said engaging hole when the respective one said engaging tongues is pulled away from said tongue-retention channel of the respective one of said brackets so as to prevent undesired removal of the respective one said engaging tongues from said tongue-retention channel of the respective one of said brackets, wherein each of said brackets includes a mounting wall that is fixed on one of said opposite sides of said lower portion of said backrest, that extends in said longitudinal direction, and that has two side edge and two spaced apart L-shaped flanges respectively extending from said side edges of said mounting wall to confine said tongue-retention channel.

* * * * *